US005256507A

United States Patent [19]

Aslam et al.

[11] Patent Number: 5,256,507

[45] Date of Patent: Oct. 26, 1993

[54] METHOD OF FUSING ELECTROSTATOGRAPHIC TONERS TO PROVIDE DIFFERENTIAL GLOSS

[75] Inventors: Muhammed Aslam; Lawrence P. Demejo, both of Rochester; Dinesh Tyagi, Fairport, all of N.Y.

[73] Assignee: Eastman Kodak Company, Rochester, N.Y.

[21] Appl. No.: 862,653

[22] Filed: Apr. 1, 1992

[51] Int. Cl.[5] ..... G03G 13/01; G03G 13/20

[52] U.S. Cl. ..... 430/42; 430/99; 430/111; 430/124

[58] Field of Search ..... 430/45, 99, 111, 124, 430/42

[56] References Cited

U.S. PATENT DOCUMENTS

| | | | |
|---|---|---|---|
| 3,578,797 | 5/1971 | Hodges | 432/228 X |
| 4,791,447 | 12/1988 | Jacobs | 430/124 |
| 4,913,991 | 4/1990 | Chiba et al. | 430/45 |
| 4,931,618 | 6/1990 | Nagata et al. | 219/216 |
| 5,089,363 | 2/1992 | Rimai et al. | 430/45 |
| 5,110,704 | 5/1992 | Inoue et al. | 430/111 X |
| 5,126,221 | 6/1992 | Chiba et al. | 430/45 |

FOREIGN PATENT DOCUMENTS

88/300254 12/1988 Japan .

*Primary Examiner*—Roland Martin

*Attorney, Agent, or Firm*—Nixon, Hargrave, Devans & Doyle

[57] ABSTRACT

A method of fusing an electrostatographic toner pattern to provide different levels of gloss in the pattern is disclosed. The pattern comprises at least one toner image formed from toner particles having a loss tangent value of 1.2 or less and at least one other toner image formed from toner particles having a loss tangent value of 1.6 or more. The pattern is subjected to fusing in three distinct zones; a fusing zone where it is contacted with a fusing member, a cooling zone where contact with the fusing member is maintained and the pattern is cooled and a release zone where the pattern is released from the fusing member at a temperature where no toner image offset occurs.

14 Claims, 1 Drawing Sheet

METHOD OF FUSING ELECTROSTATOGRAPHIC TONERS TO PROVIDE DIFFERENTIAL GLOSS

FIELD OF THE INVENTION

This invention relates to fusing electrostatographic toner images. More particularly, this invention relates to fusing an electrostatographic toner pattern comprising at least two particulate toner images to provide a different level of gloss between the fused toner images. In a specific aspect, this invention pertains to a fusing method for providing a fused electrostatographic toner pattern comprising a first image in colored toner particles and a second image in colored toner particles in which the colored toner images have different levels of gloss.

BACKGROUND

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic field pattern is developed into an electrostatographic toner pattern by contacting the field pattern with an electrostatographic developer containing an electrostatographic toner. If desired, the latent electrostatic field pattern can be transferred to another surface before such development. Although such techniques are typically used for black and white reproductions such as copying business correspondence, they are capable of forming a variety of single color or multicolor toner images.

A typical method of making a multicolor copy involves trichromatic color synthesis by subtractive color formation. In such synthesis successive latent electrostatic images are formed on a substrate, each representing a different color, and each image is developed with a toner of a different color and is transferred to a support (receiver). Typically, but not necessarily, the images will correspond to each of the three primary subtractive colors (cyan, magenta and yellow), and black as a fourth color, if desired. For example, light reflected from a color photograph to be copied can be passed through a filter before impinging on a charged photoconductive layer so that the latent electrostatic image on the photoconductive layer corresponds to the presence of yellow in the photograph. That latent image can be developed with a yellow toner and the developed image can be transferred to a support. Light reflected from the photograph can then be passed through another filter to form a latent electrostatic image on the photoconductive layer which corresponds to the presence of magenta in the photograph, and that latent image can then be developed with a magenta toner and transferred to the same support. The process can be repeated for cyan (and black, if desired).

In the systems described previously herein, the toner images may be provided on a support such as paper, film, plastic or glass to which they are permanently fixed. A common technique for fixing such toner images to a support involves employing thermoplastic polymeric toner particles which include a colorant and fusing the particles to the support by the application of heat and pressure thereto. A suitable method involves passing the support with the toner particles thereon through a pair of opposed rolls, one a heated fuser roll and the other a non-heated or heated backup roll.

It is known to use toner fusing processes to provide toner images having certain enhanced characteristics. For example, Japanese patent application No 87/133,422, filed May 30, 1987 (published unexamined Application [Kokai] No. 88/300,254, laid-open Dec. 7, 1988) hereinafter referred to as Japanese laid-open Application Number 88/300,254, describes a process for preparing documents using direct digital printing and under color removal techniques to provide documents having full-color images in which a first portion, for example text, exhibits a low gloss or matte appearance and a second portion, for example a drawing, exhibits high gloss in relation to the first portion. This Japanese application indicates that such gloss differential presents a pleasing appearance to a viewer.

The process described in Japanese laid-open application Number 88/300,254 involves (1) first forming on a support a toner image using a black toner having a loss tangent (tan $\delta$) in the range of 1.30 to 1.60 at a storage elastic modulus (G') of $10^5$ dyne/cm$^2$, (2) forming on the same support a toner image using three primary subtractive color toners having a loss tangent (tan $\delta$) in the range of 1.70 to 3.00 at a storage elastic modulus (G') of $10^5$ dyne/cm$^2$ and (3) fixing the images using a heated fuser roll. The Japanese application indicates that the aforementioned loss tangent ranges are critical to obtaining acceptable fused toner images having the required differential gloss and presents comparative data to illustrate this point.

The process described in Japanese laid-open Application No. 88/300,254 is adequate to provide gloss differential between toner images that form a fused toner pattern on a support. It is not, however, as flexible a process as would be desired to provide larger differences in gloss for a much greater variety of colored toners, as would be evidenced by lower loss tangents for black toners and higher loss tangents for subtractive color toners, as described in that application.

It is also known in the prior art that it is a problem to provide colored toner images having maximum color saturation and, in colored transparencies, maximum chroma or color clarity. Color desaturation in a colored toner image can result from light scattering or multiple reflections within the toner image. This is a problem in reflection color copies but it is particularly troublesome in color images in transparencies where such light reflection can also result in color shifts upon projection and a failure to faithfully reproduce the colors of the original image. For example, bright yellow in an original image may appear as a muddy yellow. The term often used in the prior art to describe the quality of an image projected by a transparency is "chroma" and high chroma refers to a faithful reproduction of the original colored image while low chroma refers to less than faithful or inaccurate representation of the original colored image. U.S. Pat. No. 4,791,447, issued Dec. 13, 1988, addresses the problem of providing glossy opaque toner images and high chroma transparencies using a fusing system comprising three roll members which cooperate to form a pair of roll nips.

In light of the previous discussion, it is obvious that it would be desirable to have a fusing method capable of providing differential gloss between a wide variety of toner images in an electrostatographic toner pattern. Likewise it would be desirable for such fusing method to have the capacity of providing color transparencies exhibiting excellent color clarity, i.e. high chroma. This invention provides such a fusing method.

SUMMARY OF THE INVENTION

In accordance with this invention, excellent gloss differential is provided between toner images in an electrostatographic toner pattern when the toner particles forming the images in the pattern exhibit certain specified viscoelastic flow characteristics as evidenced by their loss tangent values, measured at a storage elastic modulus (G') of $10^5$ dynes/cm$^2$, and the pattern is subjected to a fusing method comprising three zones i.e. a fusing zone, a cooling zone and a release zone, all as described in detail hereinafter. Accordingly, this invention pertains to a method which comprises (a) providing an element having a support bearing an unfused electrostatographic toner pattern which comprises a first image comprising toner particles that exhibit a loss tangent (tan $\delta$) up to about 1.2 upon fusing the pattern with heat and pressure and a second image comprising toner particles for which such loss tangent is at least 1.6, (b) passing the element successively through a fusing zone, a cooling zone and a release zone, (c) within the fusing zone, bringing the image pattern into pressure contact with a surface of a fusing member at a temperature that is sufficient (1) to cause discrete toner particles that form the first image to fuse to form a sintered mass and to adhere the fused image to the support and (2) to cause discrete particles that form the second image to flow to form a fused image in which the toner particles substantially lose their particulate identity, (d) maintaining contact between the fused image pattern and the fusing member within the cooling zone while reducing the temperature of the fusing member and (e) separating the fused image pattern from the fusing member within the release zone at a temperature where no toner image offset occurs.

A significant feature of this invention is that a transparent support can be used in the aforementioned method to provide a transparency exhibiting good color clarity and chroma, i.e. a transparency that faithfully reproduces the colors in the original image.

The method of this invention provides a technique for separating the contact fusing and fusing member release events that occur during the process by a substantial cooling phase. This is a significant distinction from roll fusing processes of the type employed in Japanese laid-open Application Number 88/300,254 where such events take place substantially simultaneously. Separating the contact fusing and fusing member release events according to the process of this invention makes it possible to use a fusing temperature which is just sufficient to cause the lower loss tangent particles to flow and adhere to the support when they exhibit significant elastic properties and then release the higher loss tangent particles when they also exhibit such elastic properties and do not offset onto the fusing member. Since the gloss of a toner image is determined by the degree of flow at the time of fusing; the gloss imparted in the fusing zone to the toner image formed from the less flowable particles (lower loss tangent) is lower than the gloss for the toner image formed in the fusing zone from the more flowable particles (higher loss tangent) and the latter image can be separated from the fusing member at a time when no offset occurs. Accordingly, the process of this invention represents an obvious advantage over roll fusing techniques of the type described in Japanese laid-open Application Number 88/300,254. Other advantages of this invention will be described in or become obvious from the following description.

DETAILED DESCRIPTION OF THE INVENTION

The unfixed or unfused toner pattern that is fused in the method of this invention comprises toner images that can be generated using any electrostatographic image-forming process capable of providing toner images comprising discrete toner particles having the loss tangents described previously herein. Such patterns can comprise line copy, continuous tone images and half-tone images as well as combinations thereof. The toner images forming the pattern can be conveniently generated using electrostatographic processes of the type described previously, including four-color toner images prepared using digital four-color, full-color printers, as described in Japanese laid-open Application No. 88/300,254, referred to previously herein.

Figure 1:
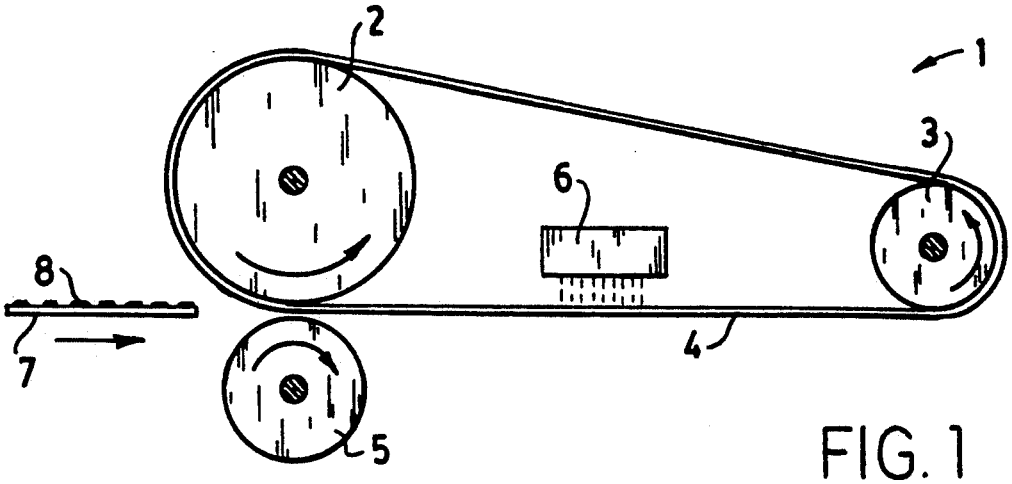
FIG. 1 is a schematic illustration of apparatus suitable for carrying out the method of this invention.

FIG. 1 illustrates preferred apparatus suitable for fusing or fixing an electrostatographic toner pattern to provide differential gloss characteristics in the pattern according to the method of this invention. FIG. 1 depicts a fusing device 1 for providing fused toner images in a fused toner pattern which images exhibit a different level of gloss. Device 1 comprises a heating roll 2, a roll 3 spaced from the heating roll 2, a fusing member 4 which is trained about heating roll 2 and roll 3 as an endless or continuous web or belt 4 which is conveyed in a counterclockwise direction, as viewed in FIG. 1, upon rotation of the heating roll 2 and roll 3. Backup or pressure roll 5 is biased against the heating roll 2 and the continuous belt 4 is cooled by impinging air provided by blower 6. In operation, support 7 bearing the unfused toner pattern 8 is transported in the direction of the arrow into the nip between heating roll 2 and backup or pressure roll 5 which can be heated if desired, where it enters a fusing zone extending about 2.5 cm laterally along continuous belt 4. Following fusing in the fusing zone, the fused image pattern then continues along the path of the belt 4 and into the cooling zone about 5 to 25 cm in length in the region following the nip between heating roll 2 and pressure roll 3. Upon exiting the fusing zone belt 1 is cooled slightly upon separation from heating roll 3 and then additionally cooled in a controlled manner by air that is caused to impinge upon belt 4 by blower 6. The fused toner image pattern on support 7 then exits the cooling zone and separates from belt 4 as the belt passes around roll 3 and is transported to copy collection means such as a tray (not shown). Support 7 bearing the fused image pattern is separated from the fusing member within the release zone at a temperature where no toner image offset occurs. This separation is expedited by using a roll 3 of relatively small diameter e.g. a diameter of about 2.5 to 4 cm. As a result of passing through the three distinct zones, i.e. the fusing zone, cooling zone and release zone, the fused toner images in the fused image pattern exhibit different levels of gloss which are normally readily perceptible to the unaided eye. The extent of each of the three zones and the duration of time the toner pattern resides in each zone can be conveniently controlled simply by adjusting the velocity or speed of belt 4. The velocity of the belt in a specific situation will depend upon several variables, including, for example, the temperature of the belt in the fusing zone, the temperature of the cooling air and the composition of the toner particles. U.S. Pat. No. 3,931,618, issued Jun. 5, 1990, describes an image glazing device that is used to apply gloss to a fused toner image or a dye image. Such device has several features in common with the fusing apparatus depicted in FIG. 1 which features are described in detail in the patent. Accordingly, U.S. Pat. No. 3,931,618 is hereby incorporated by reference herein.

Figure 2:
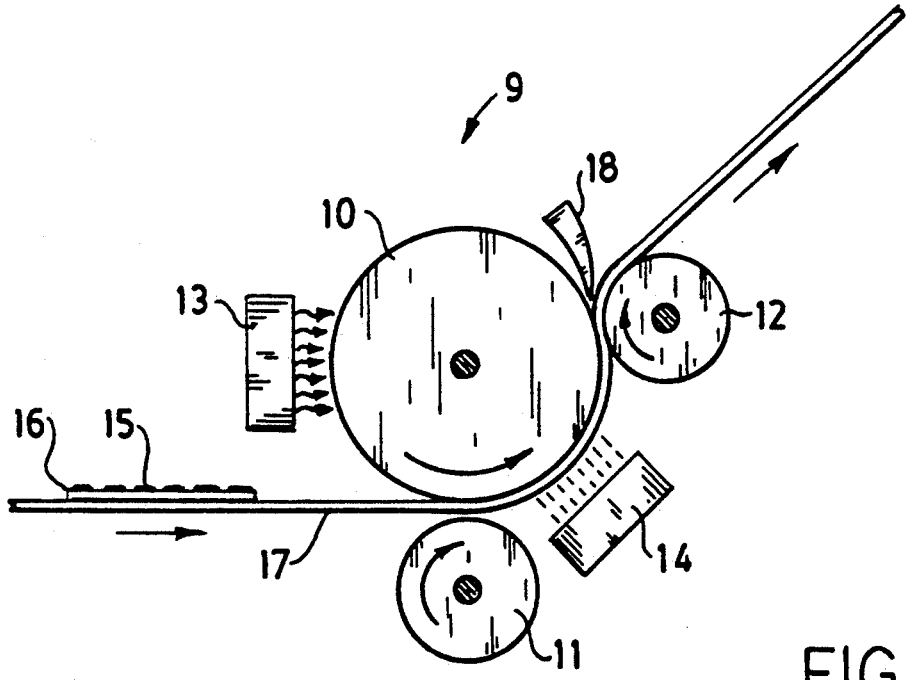
FIG. 2 is a schematic illustration of other apparatus suitable for carrying out the method of this invention.

FIG. 2 illustrates another device suitable for fusing an electrostatographic pattern to provide differential gloss according to this invention. In this device the fusing member is a roll rather than a continuous web as shown in FIG. 1. As shown in FIG. 2 the fusing device 9 comprises a roll 10, forming a nip with backup or pressure roll 11 and another nip with roll 12, continuous conveyor means 17 trained partly about rolls 10 and 12, and scive 18. Roll 10 rotates in a counterclockwise direction while rolls 11 and 12 rotate in a clockwise direction, as viewed in FIG. 2. The surface of roll 10 is heated by radiant heat from a heater 13 and is cooled by air provided by a blower 14. Support 16 bears unfused toner pattern 15. In operation, support 16 bearing unfixed or unfused toner pattern 15 comprising multiple toner images having the loss tangents described previously herein is conveyed in the direction of the arrow on continuous conveyor means 17 through the nip between rolls 10 and 11 around roll 10 and through the nip between rolls 10 and 12. The toner pattern passes through the fusing zone extending through the nip between rolls 10 and 11 and proceeds through the cooling zone where blower 14 impinges air upon conveyor 17 which cools support 16 bearing fused image pattern 15 and the surface of roll 10. Upon exiting the cooling zone support 16 bearing the fused image pattern is separated by scrive 18 from roll 10 (now in a cooled condition) after exiting the nip between roll 10 and roll 12. Upon separation support 16 bearing the fused image pattern is transported by copy handling means to copy collection means such as a tray (not shown). The fused image pattern is separated from the cooled surface of roll 10 at a temperature where no toner image offset occurs.

It is essential to this invention that the toner pattern fused in the inventive method comprise at least one toner image in toner particles that exhibit a loss tangent up to about 1.2, typically about 0.5 to 1 and at least one other toner image in toner particles that exhibit a loss tangent of at least 1.6, typically about 1.6 to 8.5 and often about 1.6 to 5.5. As discussed in Japanese laid-open Application No. 88/300,254 referred to hereinbefore, and in U.S. Pat. No. 4,913,991, issued Apr. 3, 1990, loss tangent describes the rheological characteristics (viscoelasticity) of a toner and is the ratio of the loss modulus (G″) to the storage modulus (G′). This relationship can be described by the following equation:

$$\tan \delta = \frac{\text{loss modulus}(G')}{\text{storage modulus}(G'')}$$

The rheological characteristics of the toner particles from which such loss tangent can be determined can be measured using equipment known to those skilled in the art, for example, a rheometer. An example of a suitable rheometer is a Rheometrics Model RDA 700 (commercially available from Rheometrics, Inc., Piscataway, N.J.). Another example is the Rheometrics Dynamic Spectrometer RDS-7700 made by Rheometrics, Inc., which is mentioned in the aforementioned Japanese laid-open Application Number 88/300,254 and U.S. Pat. 4,913,991. The rheological characteristics of the toners used in the present invention were measured with the Rheometrics Model RDA using parallel plates in a sinusoidal shear mode. Measurements were made at temperatures ranging from 100° to 250° C. and at frequencies ranging from 0.1 to 100 rad./sec. The loss tangent values referred to in this specification and claims are those determined for a storage (G ) modulus of $10^5$ dynes/cm$^2$ and, therefore, can be directly compared to the loss tangent values reported in Japanese laid-open Application Number 88/300,254 and U.S. Pat. No. 4,913,991.

The aforementioned loss tangents are largely determined by the toner binder polymer which is the principle determinant of the viscoelastic properties of the toners used in the practice of this invention. As understood by those skilled in the art, and as illustrated by the following Examples, Japanese laid-open Application Number 88/300,254 and U.S. Pat. No. 4,913,991; the loss tangent of a given binder material depends upon several variables, including polymer architecture (e.g. chain-branching, crosslinking or lack thereof) molecular weight distribution, glass transition temperature and additives. Accordingly, the toner particles are formulated with the type of binder polymer or combination of such polymers which meet the criteria needed to provide a desired loss tangent. Suitable toner binder materials having the low loss tangent values can comprise an additive which adjusts the loss tangent of a binder polymer to less than 1.2. Such additives can be used in concentrations up to 50 weight percent of the toner binder material, and include vinyl addition and/or polycondensation polymers that are high molecular weight and can be highly cross-linked. Such additive polymers frequently have $T_g$ values in the range of about 65° to 125° C. Polymeric beads, e.g. polymethylmethacrylate beads can be employed as useful additives. A wide variety of binder polymer materials can be employed in the toners used in the method of this invention, including vinyl addition polymers and condensation polymers. Such binder polymers are chosen for their loss tangent values as well as good combinations of advantageous properties, such as toughness, transparency, and adequate adhesion to substrates. Vinyl addition polymers that are useful as binder polymers in the toner particles can be linear, branched or lightly cross-linked. The most widely used condensation polymers are polyesters which are polymers in which backbone recurring units are connected by ester linkages. Like the vinyl addition polymers, polyester useful as binder material in toner particles can be linear, branched or lightly cross-linked. They can be fashioned from any of many different monomers, typically by polycondensation of monomers containing two or more carboxylic acid groups (or derivatives thereof, such as anhydride or ester groups) with monomers containing two or more hydroxy groups. Specific examples of useful binder polymers include olefin homopolymers and copolymers, such as polyethylene, polypropylene, polyisobutylene, and polyisopentylene; polyfluoroolefins such as polytetrafluorethylene; polyhexamethylene adipamide, polyhexamethylene sebacamide and polycaprolactam; acrylic resins, such as polymethylmethacrylate, polyacrylonitrile, polymethylacrylate, polyethylmethacrylate and styrene-methymethacrylate or ethylene-methyl acrylate copolymers, ethylene-ethyl acrylate copolymers, ethylene-ethyl methacrylate copolymers, polystyrene and copolymers of styrene with unsaturated acrylic monomers of the type mentioned hereinbefore, cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl alcohol, polyvinyl acetal, ethylene-vinyl acetate copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers and polyoxymethylene, polycondensation polymers, such as, polyesters, polyurethanes, polyamides and polycarbonates.

Binder materials that are useful in the low and high loss tangent toner particles used in the method of this invention typically are amorphous polymers having a glass transition temperature ($T_g$) in the range of about 45° to 120° C., and often about 50° to 70° C. Such polymers can be heat-fixed to smooth-surfaced film supports as well as to more conventional substrates, such as paper, without difficulty. $T_g$ can be determined by any conventional method, e.g., differential scanning calorimetry (DSC).

Fusible toner particles used in this invention can have fusing temperatures of less than about 200°, often less than 100° C. so they can readily be fused to paper sheets, even resin coated paper sheets without deformation (blistering) of the resin coating. Of course, if the toner images are fused to supports which can withstand higher temperatures, toner particles of higher fusing temperatures can be used. However, a significant advantage of this invention is that the toner particles can be fused at lower temperatures in comparison to typical prior art fusing processes because the toner particles having a loss tan of less than 1.2 needed only be heated to the point where they fuse to form a sintered mass and adhere to the support.

Numerous colorant materials selected from dyestuffs or pigments can be employed in the toner particles used in the invention. Such materials serve to color the toner and/or render it more visible. Suitable toners can be prepared without the use of a colorant material where it is desired to have developed toner image of low optical densities and different gloss levels. In those instances where it is desired to utilize a colorant, the colorants can, in principle, be selected from virtually any of the compounds mentioned in the Colour Index Volumes 1 and 2, Second Edition. Included among the vast number of useful colorants are those dyes and/or pigments that are typically employed as blue, green, red and yellow colorants used in electrostatographic toners to make color copies. Suitable colorants also include those typically employed in primary substrative cyan, magenta and yellow colored toners. Examples of useful colorants are Hansa Yellow G (C.I. 11680) CI Yellow 12, CI Solvent Yellow 16, CI Disperse Yellow 33, Nigrosine Spirit soluble (C.I. 50415), Chromogen Black ETOO (C.I. 45170), Solvent Black 3 (C.I. 26150), Fuchsine N (C.I. 42510) C.I. Pigment Red 22, C.I. Solvent Red 19, C.I. Basic Blue 9 (C.I. 52015) and Pigment Blue 15. Carbon black also provides a useful colorant. The amount of colorant added may vary over a wide range, for example, from about 1 to 20 percent of the weight of binder polymer used in the toner particles. Good results are obtained when the amount is from about 1 to 10 percent.

To utilize a binder polymer in an electrostatographic toner, the polymer particles are mixed in any convenient manner with any other desired addenda, to form a free-flowing powder of toner particles containing the binder polymer. Useful toner particles can simply comprise the binder polymer but, it is often desirable to incorporate addenda such as waxes, release agents, change control agents, and other toner addenda well known in the art.

Charge control agents suitable for use in toners are disclosed for example in U.S. Pat. Nos. 3,893,935; 4,079,014; 4,323,634 and British Patent Nos. 1,501,065 and 1,420,839. Charge control agents are generally employed in small quantifies such as, about 0.1 to 3, weight percent, often about 0.2 to 1.5 weight percent, based on the weight of toner.

Toner images fused according to this invention can be formed from electrostatographic developers comprising toner particles that are mixed with a carrier vehicle. Carrier vehicles which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822; 3,632,512; 3,795,618; 3,898,170; 4,545,060; 4,478,925; 4,076,857; and 3,970,571.

The carrier core particles can comprise conductive, non-conductive, magnetic, or non-magnetic materials. See, for example, U.S. Pat. Nos. 3,850,663 and 3,970,571. Especially useful in magnetic brush development schemes are iron particles such as porous iron Particles having oxidized surfaces, steel particles, and other "hard" or "soft" ferromagnetic materials such as gamma ferric oxides or ferrites, such as ferrites of barium, strontium, lead, magnesium, or aluminum. See for example, U.S. Pat. Nos. 4,042,518; 4,478,925; and 4,546,060.

A typical developer composition containing toner particles and carrier vehicle generally comprises about 1 to 20 percent, by weight, of particulate toner particles and from 80 to 99 percent, by weight, carrier particles. Usually, the carrier particles are larger than the toner particles. Conventional carrier particles have a particle size on the order of about 20 to 1200 micrometers, generally about 30 to 300 micrometers. Alternatively, the toners can be used in a single component developer, i.e., with no carrier particles.

The toner and developer compositions described in the previous paragraphs can be used in a variety of ways to develop electrostatic charge patterns to provide the electrostatographic toner patterns that can be fused by the method of this invention. Such developable charge patterns can be prepared by a number of means and be carried for example, on a light sensitive photoconductive element or a non-light-sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After image wise deposition of the toner particles to form an electrostatographic toner pattern, the pattern can be fixed or fused by the method of this invention to the support carrying the pattern. If desired, the unfused toner pattern can be transferred to a support such as a blank sheet of copy paper and then fused by the method of this invention to form a permanent image pattern.

Typical toner particles generally have an average particle size in the range of about 0.1 to 100 micrometers, a size of about 8 to 15 micrometers being particularly useful in the practice of this invention to form high resolution images.

In the method of this invention the toner image pattern is brought into pressure contact with the surface of the fusing member in the fusing zone. The temperature applied to fuse the toner particles causes the particles that exhibit a loss tangent up to about 1.2 to fuse into a sintered mass which adheres to the support. Due to the relatively poor flow characteristics of such toner particles, the sintered mass has an uneven or rough surface of low surface reflectivity in comparison to the fused surface a toner image formed from toner particles having a loss tangent of at least 1.6. Such surface roughness is due, at least in part, to the fact that the temperature applied to the toner pattern in the fusing zone is insufficient to cause the toner particles having a loss tangent of 1.2 or less to completely lose their particulate identity. In contrast, such temperature is sufficient to cause the discrete toner particles having a loss tangent of 1.6 or more to flow sufficiently to form a fused toner mass having a comparatively smooth surface in which the toner particles substantially lose their Particulate identity. Upon cooling in the cooling zone while in contact with the fusing member, the toner images retain the aforementioned surface characteristics which result in the different levels of gloss described herein. Typical temperatures used in the fusing zone are less than about 140° C., generally in the range of about 100° to 140° C., often 105° C. to 135° C. and preferably 115° C. to 130° C. The pressure used in this invention in combination with the aforementioned fusing temperature include those conventionally employed in contact fusing processes in the prior art. They are generally in the range of about 3 kg/cm$^2$ to 15 kg/cm$^2$ and often about 10 kg/cm$^2$. As indicated in FIGS. 1 and 2, such pressure is conveniently applied using a roll, although any suitable pressure means known to those skilled in the art could be used.

The fusing member employed in the practice of this invention can be in any physical form suitable for applying heat in a face-to-face relationship with the toner pattern and maintaining such relationship through the cooling zone. Examples are the continuous belt 4 indicated in FIG. 1 or the roll 10 indicated in FIG. 2, although it could also be in the form of a plate. A continuous belt is preferred because this provides a straight, flat fusing path which reduces curl problems that can be introduced by a roll. The surface of the fusing member is generally smooth, although a textured surface can be used, provided the surface is not so rough that it reduces the overall gloss of the fused toner pattern to an undesirable level. When a continuous belt is employed, the belt must be reasonably flexible and also heat resistant; it is preferably made with a material such as stainless steel or polyester which meet such criteria The outer surface of the fusing member which contacts the toner images can comprise any of the materials known in the prior art known to be suitable for use in such fusing surfaces, including aluminum, steel, various alloys as well as polymeric materials such as thermoset resins. Fusing members with fluoroelastomer surfaces can improve the release characteristics of the fuser member. Also release agents, for example, polymeric release oils such as polydiorganosiloxane release oils can be used. However, such additional release agents are frequently unnecessary in the practice of this invention because the toner images are cooled in the cooling zone to a level where they readily release from the fusing member without toner image offset i.e. there is no transfer of toner image to the surface of the fusing member. The toner pattern to be fused normally moves through the fusing zone at a velocity of at least about 2.5 cm/sec., typically about 2.5 to 10 cm/sec. The velocity is generally kept constant as the element bearing the toner pattern moves through the cooling and release zones.

In the cooling zone, cooling of the fused toner pattern is controlled so that it can be released at a temperature where no toner image offset occurs. The temperature of the fused image pattern is generally reduced at least about 40° C., often about 65° to 90° C. in the cooling zone. As previously indicated herein, cooling can conveniently be controlled simply by controlling the velocity of the fusing member, for example, the velocity of a continuous belt or roll while cooling air is impinged upon the belt, or upon the element, as in FIG. 2, although other cooling means such as a chill roll or plate could be used in place of air impingement. When a continuous belt is used as the fusing member, it usually is not necessary to press the element against the fusing member to maintain contact between the fusing member and the toner image pattern because the toner image pattern is heated in the fusing zone to a point where the fused pattern surface acts as an adhesive which temporarily bonds to the fusing member as the fused toner pattern moves through the cooling zone i.e. the fused toner pattern.

In the release zone the fused toner pattern is separated from the fusing member. Such release is not effected until the fusing member is cooled to a temperature where no toner image offset occurs. Such temperature is typically no more than about 75° C. and is normally in the range of about 30° to 60° C. The specific temperature used to achieve such separation will vary considerably as it depends upon the flow properties of the toner particles having a loss tangent of at least 1.6. The release temperature chosen is such that the toner image exhibits a significant elastic characteristic and adheres to the support and exhibits sufficient cohesiveness such that it will not offset on the fuser member at the particular temperature used. Upon separation from the fusing member in the release zone, the toner image formed from toner particles exhibiting a loss tangent up to 1.2 exhibits lower gloss in comparison to the toner image formed from toner particles having a loss tangent of at least 1.6. The lower gloss levels are typically less than about 30, often in the range of 1 to about 20 while the gloss levels for toner images formed from particles having a loss tangent of at least 1.6 are typically at least 50 and often in the range of about 50 to 100. Such gloss levels are readily perceptible to the unaided eye but they can be measured by a specular glossmeter at 20° using conventional techniques well known to those skilled in the art for this purpose for example, the method described in ASTM-D523-67. A typical method utilizes a single reflectivity measurement as of a type which measures the amount of light from a standard source which is specularly reflected in a defined path. A suitable device for this purpose is a Glossgard II 20° glossmeter (available commercially from Pacific Scientific Inc., Silver Springs, Md.) which produces a reading, on a standardized scale, of a specularly reflected ray of light having angles of incidence and reflection of 20° to the normal. The standard scale of such meter has a range from 0 to 100, the instrument being normally calibrated or adjusted so that the upper limit corresponds to a surface that has substantially less than the complete specular reflection of a true mirror. Reflectivity readings are indicated as gloss numbers. As previously indicated herein, the method of this invention provides not only fused toner images having different levels of gloss, but it can also provide transparencies having colored toner images on transparent supports which images exhibit good color clarity. As known to those skilled in the art, color clarity can be defined as the ratio of specular to total transmitted light expressed in percent. Such color clarity can be conveniently determined by placing an image on a transparent support in an optical light path and separately measuring or reading the specular and totally transmitted light with a suitable device, e.g., a photometer.

Various conductive or nonconductive materials can be used as supports for the toner pattern fused in the method of this invention. Such supports are well known to those skilled in the art and include various metals such as aluminum and copper and metal-coated plastic films as well as organic polymeric films and various types of paper. Polyethylene terephthalate is an excellent transparent polymeric support for use in forming transparencies.

The following preparation and fusing techniques and examples are presented to further illustrate this invention.

In some of the preparations and examples polymer names contain an indication of the molar or weight ratios of the various units in the polymer, as specified. In some of the preparations and examples (as indicated therein), the relative concentrations of units are expressed as ratios or amounts of the monomers used to prepare the polymer.

Developer Formulation, Imaging and Fusing

Toner particles employed to form the toner images in the following examples were formulated from 100 parts binder polymer, 0–20 parts colorant, 0–20 parts addenda and 0–2 parts of charge agent per 100 parts binder polymer. The mixtures were melt-compounded at temperatures in the range of 110° to 150° C. on a 2-roll rubber mill, the mass cooled to room temperature, and coarse ground and fluid energy-milled to produce toner particles having a particle size in the range of about 8 to 15 micrometers.

The toner particles were then mixed with carrier particles in a closed container on a 2-roll mill for 30 seconds to form a triboelectrically-charged 2-component dry electrostatographic developer comprising about 12 weight percent toner particles. The carrier particles employed were strontium ferrite particles coated with a thin poly(vinylidene fluoride) film.

The electrostatographic developer was used to develop a toner images on a bond paper support. Biased development was carried out in an electrophotographic copying apparatus having an organic photoconductor film, a magnetic brush developing station and a biased roll transfer station for transferring the toner pattern from the photoconductor film to the bond paper support. The toner pattern comprised line copy toner images and half-tone screen toner images in which the line copy toner images were developed with toner particles having a loss tangent of 1.2 or less and the half-tone screen toner images were developed with toner particles having a loss tangent of 1.6 or more.

The toner pattern was fused using a fusing device of the type illustrated in FIG. 1 in which the fusing member was a continuous, highly polished smooth steel belt. The fusing conditions used were as follows:

| | |
|---|---|
| Belt Velocity | 6.5 cm/sec. |
| Fusing Temperature | 105°–130° C. |
| Pressure | 3–15 kg/cm$^2$ |
| Nip Width | 0.4–0.6 cm |
| Cooling Air Temperature | 20°–25° |
| Release Temperature at Roll | 40°–65° C. |

EXAMPLE 1

The fusing method of this invention is effective to provide a fused toner pattern comprising distinct toner images having different levels of gloss. To illustrate, developer compositions comprising the following toners were prepared as described previously in the Developer Formulation, Imaging and Fusing section.

Toner I

Toner particles were formulated from 100 parts of a binder polymer comprising 90 percent, by weight poly(styrene-co-n-butylacrylate)[77/23 weight percent] cross-linked with 0.4 parts per hundred divinylbenzene, having a $T_g$ of 65° a weight-average molecular weight ($\overline{M}_w$) of 275,000 and a number average molecular weight ($\overline{M}_n$) of 31,000 and 10 percent, by weight, of polystyrene having a $T_g$ of 102° C. a weight-average molecular weight of 285,000 and a number average molecular weight of 102,000, 6 parts of a yellow colorant and 1 part of a quaternary ammonium charge agent. The pulverized toner particles were classified to provide toner particles having a particle size of 10 to 12 micrometers and a loss tangent of 0.7 determined for a storage modulus, G', of $10^5$ dynes/cm$^2$ (G' of $2.33\times10^5$ dynes/cm$^2$, G'' of $1.29\times10^5$ dynes/cm$^2$ and melt viscosity of $2.66\times10^5$ poise measured at a temperature of 150° C. and 1 rad/sec.) all measured using a Rheometrics Model RDA 700 rheometer commercially available from Rheometrics, Inc., Piscataway, N.J. using parallel plates in a sinusoidal shear mode. This Toner I was used to develop the line copy image as previously described in the Developer Formulations, Imaging and Fusing section.

Toner II

Toner particles were formulated from 100 parts of a binder polymer comprising a branched polyester of terephthalic acid, glutaric acid, propanediol and glycerol (87/13/95/5 molar ratios) having an inherent viscosity of 0.4 dl/g in dichloromethane, a $T_g$ of 62° C. a weight-average molecular weight of 70,000 and a $\overline{M}_n$ of 10,000, 6 parts of a cyan colorant and 1 part of a quaternary ammonium charge agent. The pulverized toner particles were classified to provide cyan toner particles having a loss tangent of 2.1 determined for a storage modulus, G', of $10^5$ dynes/cm$^2$ (G' of $2.01\times10^3$ dynes/cm$^2$, G'' of $1.05\times10^4$ dynes/cm$^2$ and a melt viscosity of $1.07\times10^4$ poise measured at a temperature of 150° C. and 1 rad/sec.) measured in the same manner as Toner I using the Rheometrics Model RDA 700 rheometer. This Toner II was used to develop the half-tone screen image as described previously in the Developer Formulation, Imaging and Fusing section.

The gloss of the images provided by Toner I and Toner II were determined using a MICRO TRI glossmeter (commercially available from Byk Gardner Inc., Silver Springs, Md.) at an angle of 20°. The average gloss for 5 readings on each image was determined. The gloss obtained with the Toner I line copy image was 10 while the gloss determined for the Toner II half-tone screen image was 65.

As previously indicated herein, the fusing method of this invention is useful for forming transparent image-recording materials exhibiting excellent color clarity upon projection. To illustrate this feature of the invention this Example 1 was repeated except that the unfused toner pattern was developed on a transparent poly(ethylene) terphthalate film 101.6 micrometers thick, coated with a subbing layer comprising a terpolymer of acrylonitrile, vinylidene chloride and acrylic acid. Upon projection in an overhead projector the yellow line copy image and the cyan half-tone screen image both showed high color density and saturation comparable to the original images. The color clarity for each of the images, determined as described previously herein was approximately 90 percent.

EXAMPLE 2

The procedure of Example 1 was repeated except that the following Toner III was used in place of Toner I.

Toner III

Toner particles were formulated from 100 parts of a binder polymer comprising 90 percent, by weight poly(styrene-co-n-butylacrylate)[77/23 weight percent], having a $T_g$ of 68° C. and a weight-average molecular weight ($\overline{M}_w$) of 47,000 and a number average molecular weight ($\overline{M}_n$) of 23,000 10 percent, by weight, of a styrene-alkylene designation "Kraton 1652") having a $T_g$ of 90° C., a weight-average molecular weight of 87,000 and a $\overline{M}_n$ of 81,600, 6 parts of a black colorant and 1 part of a quaternary ammonium charge agent. The pulverized toner particles were classified to provide black toner particles having a particle size of 8–10 micrometers and a loss tangent of 0.5 determined for a storage modulus, G', of $10^5$ dynes/cm$^2$ (G' of $2.10\times10^5$ dynes/cm$^2$, G'' of $1.26\times10^5$ dynes/cm and melt viscosity of $2.40\times10^5$ poise measured at a temperature of 150° C. and 1 rad/sec.) measured as described in Example 1. This Toner III was used to develop the line copy image as described in Example 1. The gloss of this image, determined as in Example 1, was 7 while the gloss for the Toner II half-tone screen image was 65, as reported in Example 1.

EXAMPLE 3

The procedure of Example 1 was repeated except that the following Toner IV was used in place of Toner I.

Toner IV

Toner particles were formulated from 100 parts of a binder polymer comprising poly(styrene-co-n-butylacrylate)[77/23 weight percent] crosslinked with 0.4 parts per hundred divinylbenzene, having a $T_g$ of 65° C. and a weight-average molecular weight ($\overline{M}_w$) of 275,000 and a number average molecular weight ($\overline{M}_n$) of 31,000, 6 parts of a black colorant and 1 part of a quaternary ammonium charge agent. The pulverized toner particles were classified to provide black toner particles having a particle size of 6–8 micrometers and loss tangent of 0.8 determined for a storage modulus, G', of $10^5$ dynes/cm$^2$ (G' of $1.24\times10^5$ dynes/cm$^2$, G'' of $8.54\times10^4$ dynes/cm$^2$ and melt viscosity of $1.51\times10^5$ poise measured at a temperature of 150° C. and 1 rad/sec.), measured as described in Example 1. This Toner IV was used to develop the line copy image as described in Example 1. The gloss of the image, determined as in Example 1, was 12 while the gloss for the Toner II half-tone screen image was 65, as reported in Example 1.

EXAMPLE 4

The procedure of Example 1 was repeated except that the following Toner V was used in place of Toner I.

Toner V

Toner particles were formulated from 100 parts of a binder polymer comprising poly(styrene-co-n-butylacrylate)[80/20 weight percent] crosslinked with 1.3 parts per hundred divinylbenzene, having a $T_g$ of 65° C., a weight-average molecular weight ($\overline{M}_w$) of 410,000 and a number average molecular weight ($\overline{M}_n$) of 10,000, 6 parts of a black colorant and 1 part of a quaternary ammonium charge agent. The pulverized toner particles were classified to provide black toner particles having a particle size of 6–8 micrometers and a loss tangent of 1.2 determined for a storage modulus, G', of 10 dynes/cm$^2$ (G' of $4.98\times10^3$ dynes/cm$^2$, G'' of $1.01\times10^4$ dynes/cm$^2$ and melt viscosity of $1.12\times10^4$ poise measured at a temperature of 150° C. and 1 rad/sec.) measured as described in Example 1. This Toner V was used to develop the line copy image as described in Example 1. The gloss of the image, determined as in Example 1, was 20 percent while the gloss for the Toner II half-tone screen image was 65, as reported in Example 1.

EXAMPLE 5

The procedure of Example 3 was repeated except that Toner VI was used in place of Toner II.

Toner VI

Toner particles were formulated from 100 parts of a binder polymer comprising poly(styrene-co-n-butylacrylate)[80/20 weight percent] having a $T_g$ of 68° C., a weight-average molecular weight ($\overline{M}_w$) of 47,000, a number average molecular weight ($\overline{M}_n$) of 23,000, and 8 parts of a blue colorant. The pulverized toner particles were classified to provide blue toner particles having a particle size of 7–9 micrometers and a loss tangent of 2.6 determined for a storage modulus, G', of $10^5$ dynes/cm$^2$ (G' of $5.84\times10^1$ dynes/cm$^2$, G'' of $1.86\times10^3$ dynes/cm$^2$ and melt viscosity of $186\times10^3$ poise measured at a temperature of 150° C. and 1 rad/sec.) measured as described in Example 1. This Toner VI was used to develop the half-tone screen image as described in Example 1. The gloss of the image, determined as in Example 1, was 70 while the gloss for the Toner IV line copy image was 12, as reported in Example 3.

Toner particles prepared according to the procedure of this Example from the following high loss tangent binder polymers provide similar high levels of gloss;

(1) Poly(styrene-co-n-butylacrylate) [80/20 weight percent] having a $T_g$ of 68° C., a weight-average molecular weight ($\overline{M}_w$) of 23,000, a number-average molecular weight ($\overline{M}_n$) of 12,000 and a loss tangent of 3.2 determined for a storage modulus, G', of 10 dynes/cm$^2$ (G' of $2.46\times10^0$ dynes/cm$^2$, G'' of $4.651\times10^2$ dynes/cm$^2$ and melt viscosity of $4.651\times10^2$ poise measured at a temperature of 150° C. and 1 rad/sec.) measured as described in Example 1.

(2) Polystyrene having a $T_g$ of 59° C., a weight-average molecular weight ($\overline{M}_w$) of 9,000, a number-average molecular weight ($\overline{M}_n$) of 2,500 and a loss tangent of 5.4 determined for a storage modulus, G', of 10 dynes/cm$^2$ (G'' of $4.061\times10$ dynes/cm$^2$, G'' of $3.356\times10^1$ dynes/cm$^2$ and melt viscosity of $3.381\times10^1$ poise measured at a temperature of 150° C. and 1 rad/sec.) measured as described in Example 1.

(3) Polystyrene having a $T_g$ of 68° C., a weight-average molecular weight ($\overline{M}_w$) of 4,400 a number-average molecular weight ($\overline{M}_n$) of 1,700 and a loss tangent of 8.0 determined for a storage modulus, G', of $10^5$ dynes/cm$^2$ (G' of $8.6\times10^{-1}$ dynes/cm$^2$, G'' of $2.71\times10^2$ dynes/cm$^2$ and melt viscosity of $2.71\times10^2$ poise measured at a temperature of 150° C. and 1 rad/sec.) measured as described in Example 1.

It is evident from the foregoing specification, and particularly the Examples, that the fusing method of this invention makes it possible to obtain toner images exhibiting different levels of gloss from toner particles having widely varying viscoelastic properties, as evidenced by the wide diversity of loss tangent values that such particles exhibit upon fusing by the combined action of heat and pressure. Furthermore, fusing is achieved at lower temperatures than are normally used in prior art contact fusing processes without unwarranted toner offset. In addition, color transparencies that faithfully reproduce the color of an original image can be prepared using the fusing method of this invention.

The invention has been described in detail with particular reference to certain preferred embodiments thereof, but it should be appreciated that variations in modification can be effected within the spirit and scope of the invention.

We claim:

1. A method of fusing an electrostatographic toner pattern to provide differential gloss in the pattern, which method comprises:

a. providing an element having a support bearing the unfused pattern which comprises a first image comprising toner particles that exhibit a loss tangent (tan δ) up to about 1.2 upon fusing the pattern with heat and pressure and a second image comprising toner particles for which such loss tangent is at least 1.6;

b. passing the element successively through a fusing zone, a cooling zone and a release zone;

c. within the fusing zone, bringing the image pattern into pressure contact with a surface of a fusing member at a temperature that is sufficient (1) to cause discrete toner particles that form the first image to fuse to form a sintered mass and to adhere the fused image to the support and (2) to cause discrete particles that form the second image to flow to form a fused image in which the toner particles substantially lose their particulate identity;

d. maintaining contact between the fused image pattern and the fusing member within the cooling zone while reducing the temperature of the fusing member; and e. separating the fused image pattern from the fusing member within the release zone at a temperature where no toner image offset occurs.

2. The method of claim 1, wherein the loss tangent for the first toner image particles is in the range of about 0.5 to 1.

3. The method of claim 1, wherein the loss tangent for the second toner image particles is in the range of about 1.6 to 5.5.

4. The method of claim 2, wherein the loss tangent for the second toner image particles is in the range of about 1.6 to 5.5.

5. The method of claim 3, wherein the first image is a black toner image.

6. The method of claim 5, wherein the second image is a cyan toner image.

7. The method of claim 1, wherein the toners in the first and second images comprise polyester binders.

8. The method of claim 1, wherein the first and second images comprise styrene-acrylic copolymer binders.

9. The method of claim 1, wherein the fusing member is a continuous belt.

10. The method of claim 4, wherein the fusing member is a continuous belt.

11. The method of claim 9, wherein the temperature of the fusing member is less than about 140° C.

12. The method of claim 10, wherein the temperature of the fusing member is less than about 140° C.

13. The method of claim 1, wherein the particle size of the first and second image particles is in the range of about 8 to 15 micrometers.

14. The method of claim 13, wherein the temperature of the fusing member is less than about 140° C.

* * * * *